US007261289B2

(12) United States Patent
Lee et al.

(10) Patent No.: US 7,261,289 B2
(45) Date of Patent: Aug. 28, 2007

(54) AUTOMATIC DOCUMENT FEEDER FOR IMAGE FORMING APPARATUS

(75) Inventors: Seung-Jae Lee, Suwon-si (KR); Sang-Jin Bae, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 410 days.

(21) Appl. No.: 10/970,652

(22) Filed: Oct. 22, 2004

(65) Prior Publication Data

US 2005/0110205 A1 May 26, 2005

(30) Foreign Application Priority Data

Oct. 25, 2003 (KR) ..... 10-2003-0074925

(51) Int. Cl.
*B65H 5/00* (2006.01)

(52) U.S. Cl. ..... 271/10.04; 271/10.11; 271/10.09; 271/109

(58) Field of Classification Search ..... 271/10.01, 271/10.04, 10.09, 10.11, 10.13, 109, 121; 74/396, 397
See application file for complete search history.

(56) References Cited

U.S. PATENT DOCUMENTS

| | | | | |
|---|---|---|---|---|
| 5,160,128 | A | 11/1992 | Oishi | 271/114 |
| 6,019,363 | A | 2/2000 | Ahn | 271/10.05 |
| 6,485,011 | B1 * | 11/2002 | Yen et al. | 271/10.03 |
| 6,811,151 | B2 * | 11/2004 | Wei-Feng et al. | 271/10.03 |
| 6,962,332 | B2 * | 11/2005 | Su | 271/4.01 |
| 6,974,127 | B2 * | 12/2005 | Kang | 271/10.11 |
| 2004/0026849 | A1 * | 2/2004 | Kang et al. | 271/265.01 |

FOREIGN PATENT DOCUMENTS

| | | |
|---|---|---|
| JP | 01-197262 | 8/1989 |
| JP | 05-014639 | 1/1993 |
| JP | 07-129018 | 5/1995 |
| JP | 09-150985 | 6/1997 |
| JP | 2000-095422 | 4/2000 |
| JP | 2000-351243 | 12/2000 |
| JP | 2001-187655 | 7/2001 |
| KR | 2000-0045654 | 7/2000 |
| KR | 20000045654 | * 7/2000 |

* cited by examiner

*Primary Examiner*—Patrick Mackey
*Assistant Examiner*—Michael McCullough
(74) *Attorney, Agent, or Firm*—Roylance, Abrams, Berdo & Goodman, LLP

(57) ABSTRACT

An automatic document feeder for an image forming apparatus comprising a separation roller for separately carrying a plurality of paper sheets picked by a pickup roller, a feeding roller for carrying the paper sheets, a discharge roller for discharging the scanned paper sheets, and a transmission unit for transmitting a driving force from a driving motor. The transmission unit comprises an internal roller installed on the same axis as the feeding roller, the internal roller having an internal gear, a swing arm rotatably attached to a bracket, the bracket being inserted into the internal roller, and a swing gear rotatably installed on one side of the swing arm, the swing gear being engaged with the internal gear for rotating the internal roller.

13 Claims, 9 Drawing Sheets

AUTOMATIC DOCUMENT FEEDER FOR IMAGE FORMING APPARATUS

CROSS-REFERENCE TO RELATED APPLICATIONS

This application claims the benefit under 35 U.S.C. §119 (a) of Korean Patent Application No. 2003-74925, filed in the Korean Intellectual Property Office on Oct. 25, 2003, the entire contents of which are incorporated herein by reference.

BACKGROUND OF THE INVENTION

1. Field of the Invention

The present invention relates to an automatic document feeder for an image forming apparatus. More particularly, the present invention relates to an automatic document feeder for an image forming apparatus that automatically separates and delivers sheets of paper.

2. Description of the Related Art

An image forming apparatus is generally a device used to form a visual image onto a sheet of paper with regard to an image signal. During the process of forming an image, a developer receives a digital image signal and then causes toner to be attached to an electrostatic latent image made on a photosensitive medium. Accordingly, a toner image is then transferred to a sheet of paper and heated thereon by a fixing roller such that the heated toner image is fixedly melted and thereby forming a visual image.

Such an image forming apparatus, especially a multi-functional device or a scanner, employs an automatic document feeder for automatically separating sheets of an original document to be scanned, and then supplying them to a scan module.

FIG. 1 is a lateral sectional view which shows a configuration of a conventional automatic document feeder for an image forming apparatus. FIGS. 2 and 3 are lateral sectional views for explaining an operation of the conventional automatic document feeder depicted in FIG. 1.

Referring to FIG. 1, an automatic document feeder 10, mounted on an image forming apparatus (not shown), includes an upper cover 11, a scan module 20 installed under the automatic document feeder 10 to scan sheets of paper P, a glass plate 22 over which the sheets of paper are transferred during scanning and which is placed above the scan module 20, and a white bar 21 to guide the sheets of paper P closely along the glass plate 22 during scanning.

The automatic document feeder 10 further includes a document loading tray 12 for storing the sheets of paper P, a pickup roller 13 for drawing the sheets of paper P stacked in the document loading tray 12, and a separation roller 14 for separating the sheets of paper P drawn up by the pickup roller 13 one by one, and moving them in a scanning direction via a friction difference. The automatic document feeder 10 also includes a friction pad 15 installed opposite to the separation roller 14, a pair of feed rollers 16 and 17 installed along the path of the sheets of paper P for moving them to the scan module 20, a discharge roller 18 for unloading sheets of paper P scanned by the scan module 20, and a compression roller 19 installed opposite to the discharge roller 18 for pressing the sheets of paper P against the discharge roller 18 during scanning.

The rollers in the automatic document feeder 10 are actuated by a single driving motor (not shown) and are engaged with one another via a mechanism, such as gears (not shown). When the driving motor rotates, the rollers also rotate. However, if all rollers are designed to rotate simultaneously, the sheets of paper P cannot be separately carried. For this reason, clutches (not shown) are respectively employed so that the corresponding rollers do not rotate when necessary.

Referring to FIG. 2, when the driving motor rotates forward, the pickup roller 13 and the separation roller 14 rotate clockwise to respectively pick up and separate the sheets of paper P. In this case, the clutches prevent the feeding rollers 16 and 17, and the discharge roller 18 from rotating clockwise to prevent scanned and discharged sheets of paper P from being inserted back into the automatic document feeder 10. When a front end of the sheets of paper P reaches the feeding rollers 16 and 17, the driving motor then starts to rotate backward.

Referring to FIG. 3, due to the backward rotation of the driving motor, the feeding roller 16 and the discharge roller 18 rotate counterclockwise to discharge scanned sheets of paper P. While respective clutches make the pickup roller 13 and the separation roller 14 rotate counterclockwise due to the backward rotation of the driving motor, the pickup roller 13 is detached from the sheets of paper P and the separation roller 14 is placed in an idle rotation state due to a feeding force of the sheets of paper.

As described above, since a clutch is employed for each roller to control its rotation direction, the cost of the feeder 10 increases. In addition, since the motion transfer is achieved via gears, the feeder 10 has an increased and complicated volume.

Accordingly, a need exists for an automatic document feeder system having a smaller structure and requiring fewer clutch mechanisms to further reduce paper jams and manufacturing costs.

SUMMARY OF THE INVENTION

The present invention solves the above and other problems by providing an automatic document feeder having a reduced volume by using a simplified motion transfer structure and a smaller number of clutches.

According to an object of the present invention, an automatic document feeder is provided for an image forming apparatus comprising a separation roller for separately carrying a plurality of paper sheets picked up by a pickup roller, a feeding roller for carrying the sheets of paper, a discharge roller for discharging scanned sheets of paper, and a transmission unit for transmitting a driving force from a driving motor. The transmission unit includes an internal roller installed on the same axis as the feeding roller, the internal roller having an annular gear, a swing arm rotatably attached to a bracket, the bracket being inserted into the internal roller, and a swing gear rotatably installed on one side of the swing arm, the swing gear being engaged with the annular gear for rotating the internal roller.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF THE EXEMPLARY EMBODIMENTS

Figure 1:
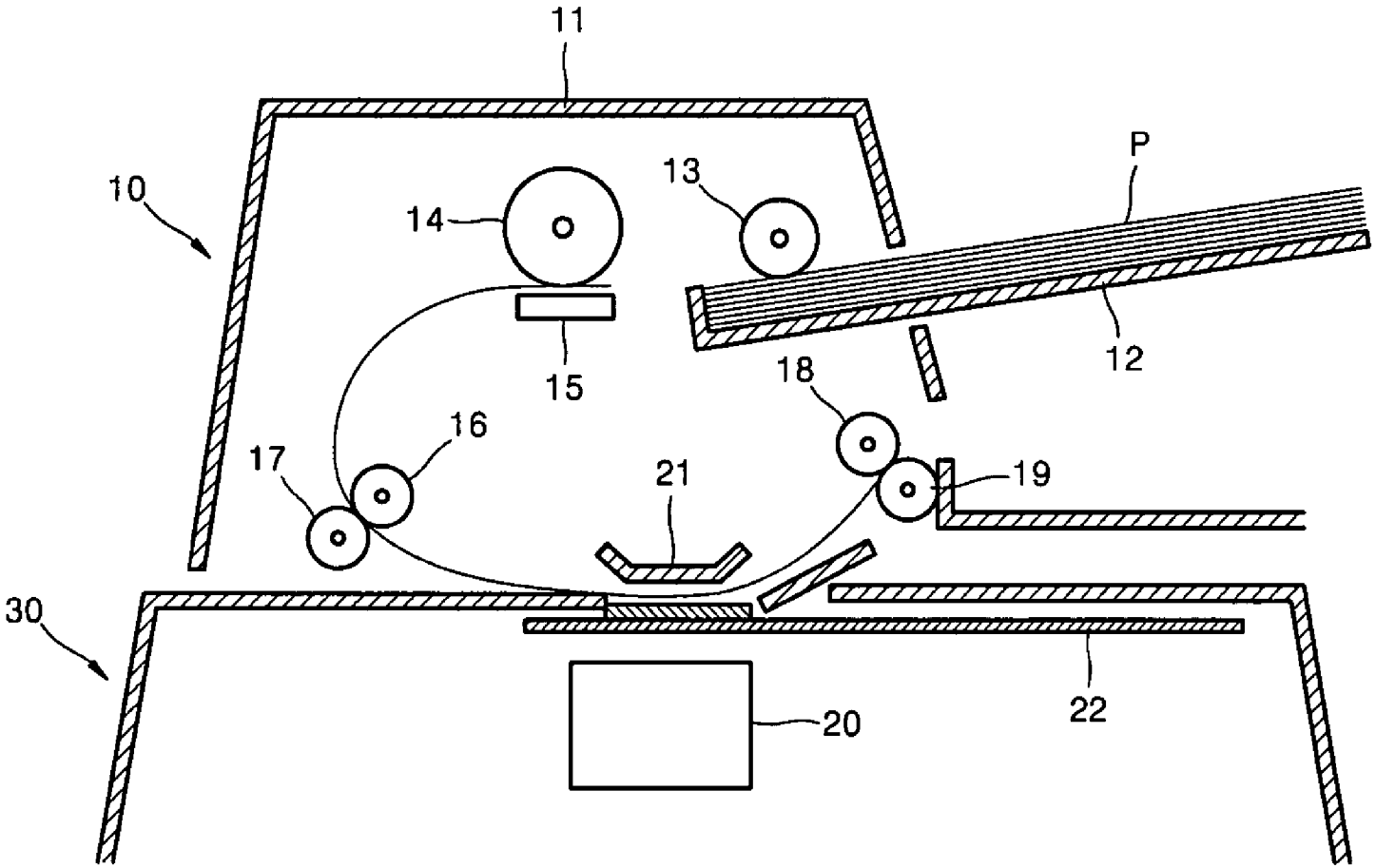
FIG. 1 (PRIOR ART)
FIG. 1 is a lateral sectional view showing a configuration of a conventional automatic document feeder for an image forming apparatus.
Figure 2:
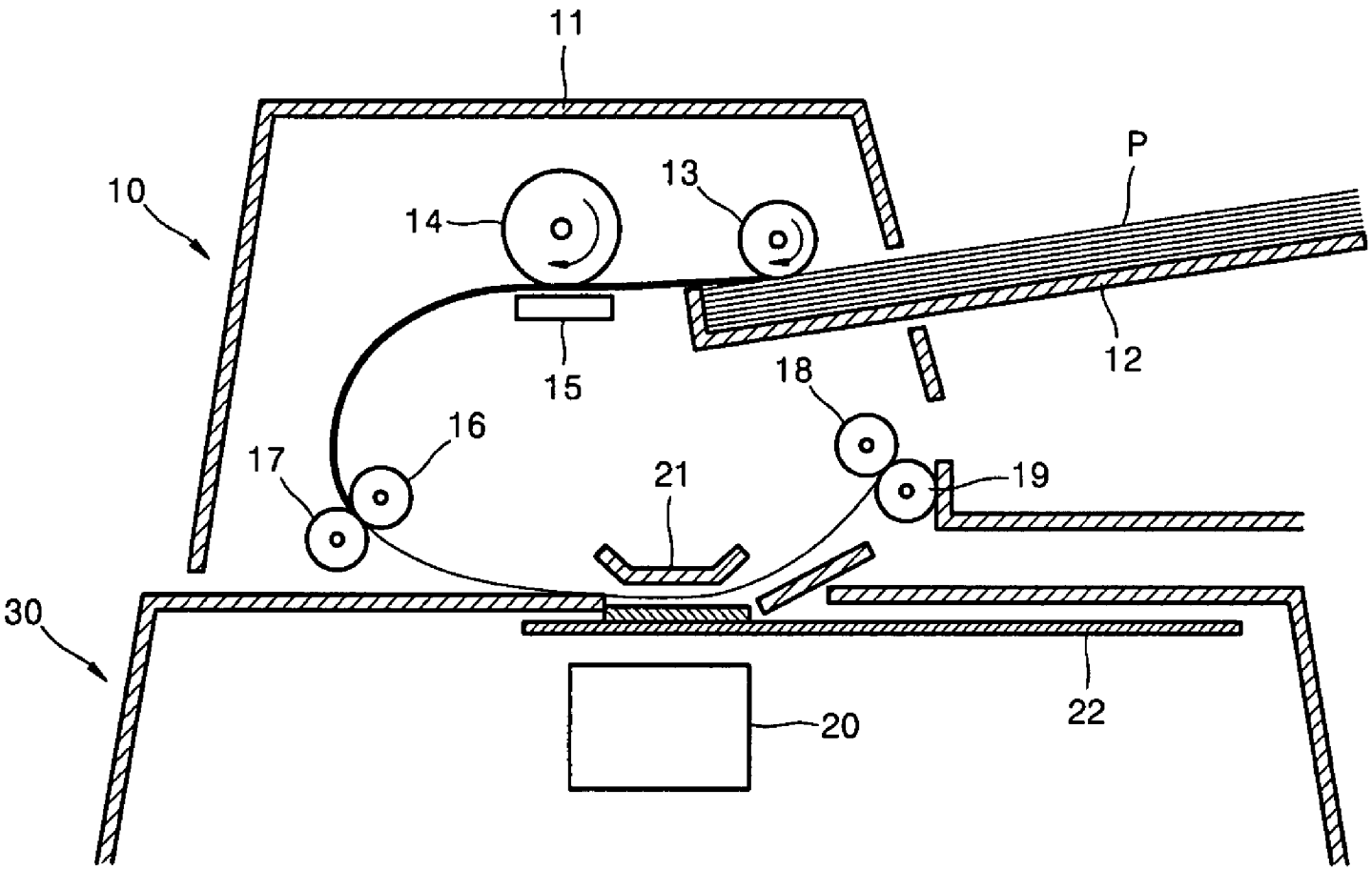
FIG. 2 (PRIOR ART)
FIGS. 2 and 3 are lateral sectional views for explaining an operation of the conventional automatic document feeder shown in FIG. 1.
Figure 3:
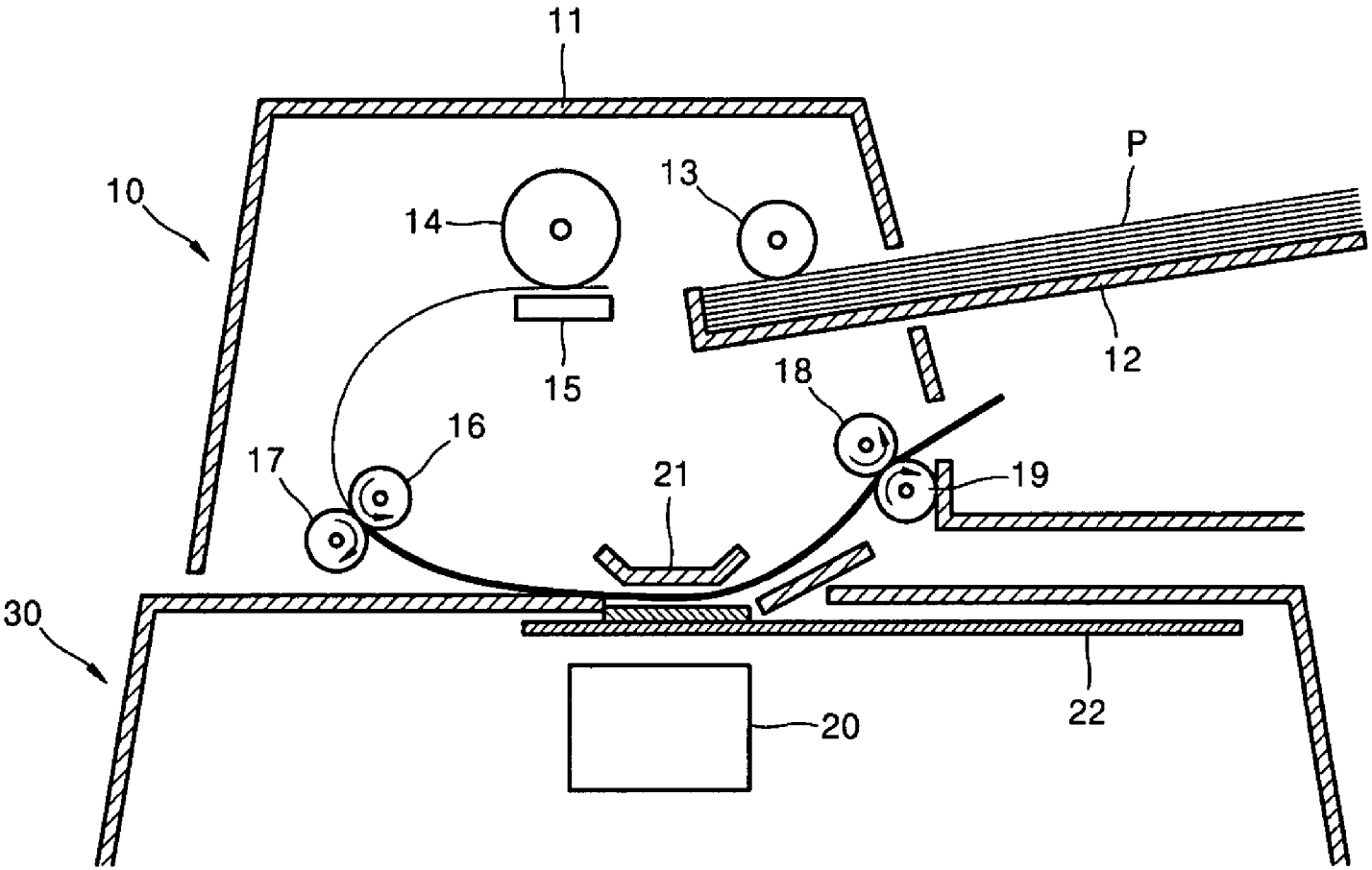
FIG. 3 (PRIOR ART)
Figure 4:
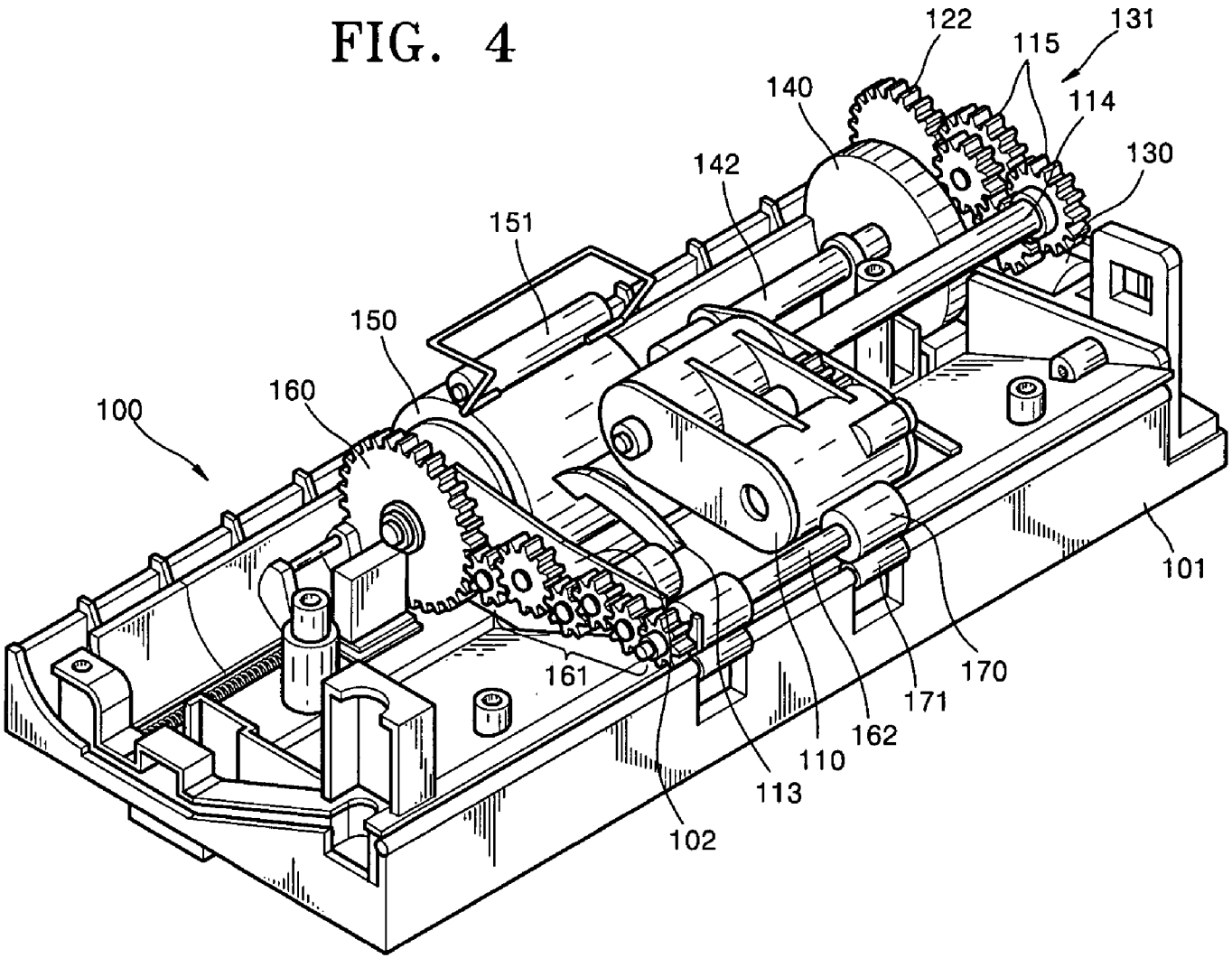
FIG. 4 is a perspective view of an automatic document feeder according to an embodiment of the present invention.
Figure 5:
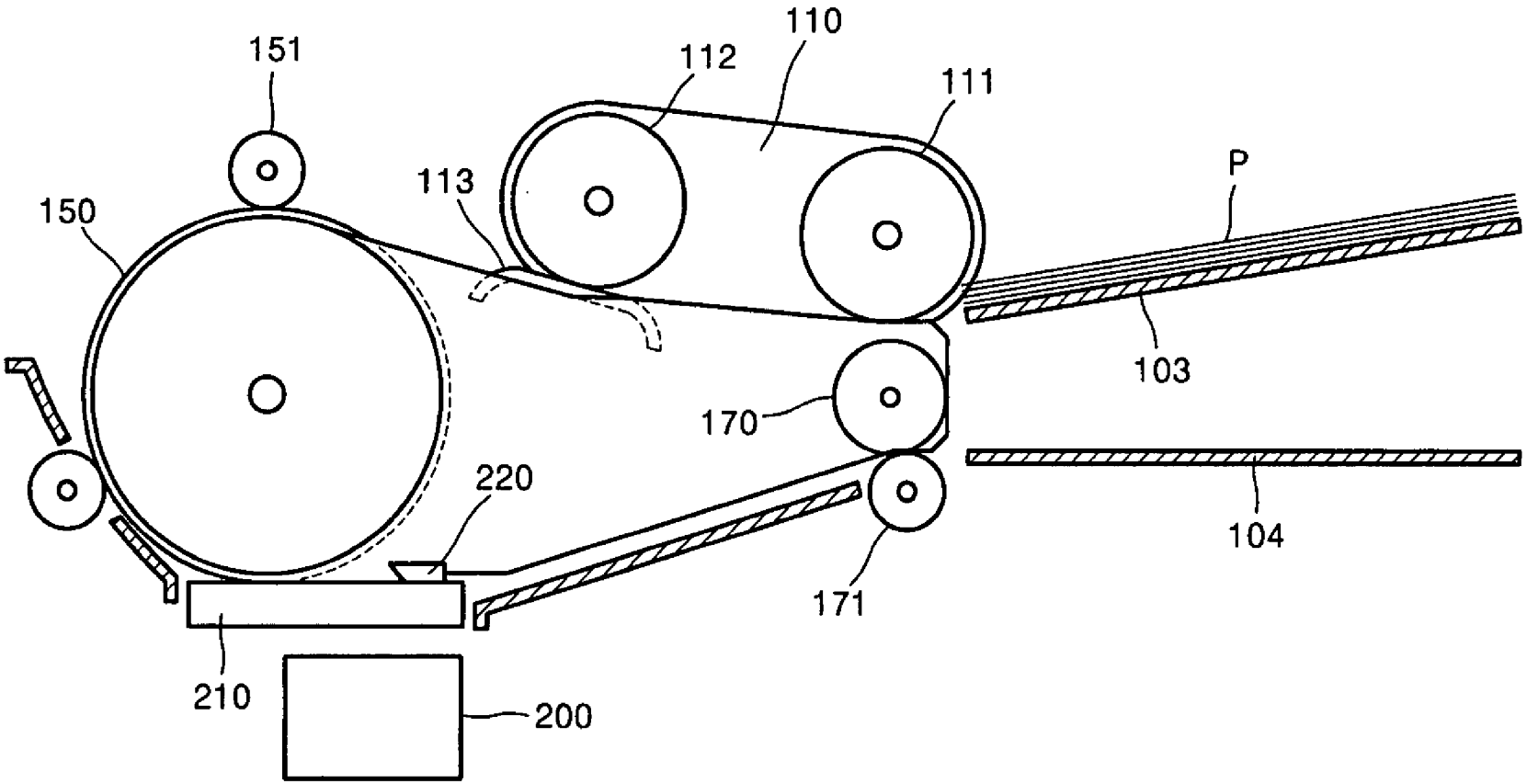
FIG. 5 is a lateral sectional view of the automatic document feeder shown in FIG. 4.
Figure 6:
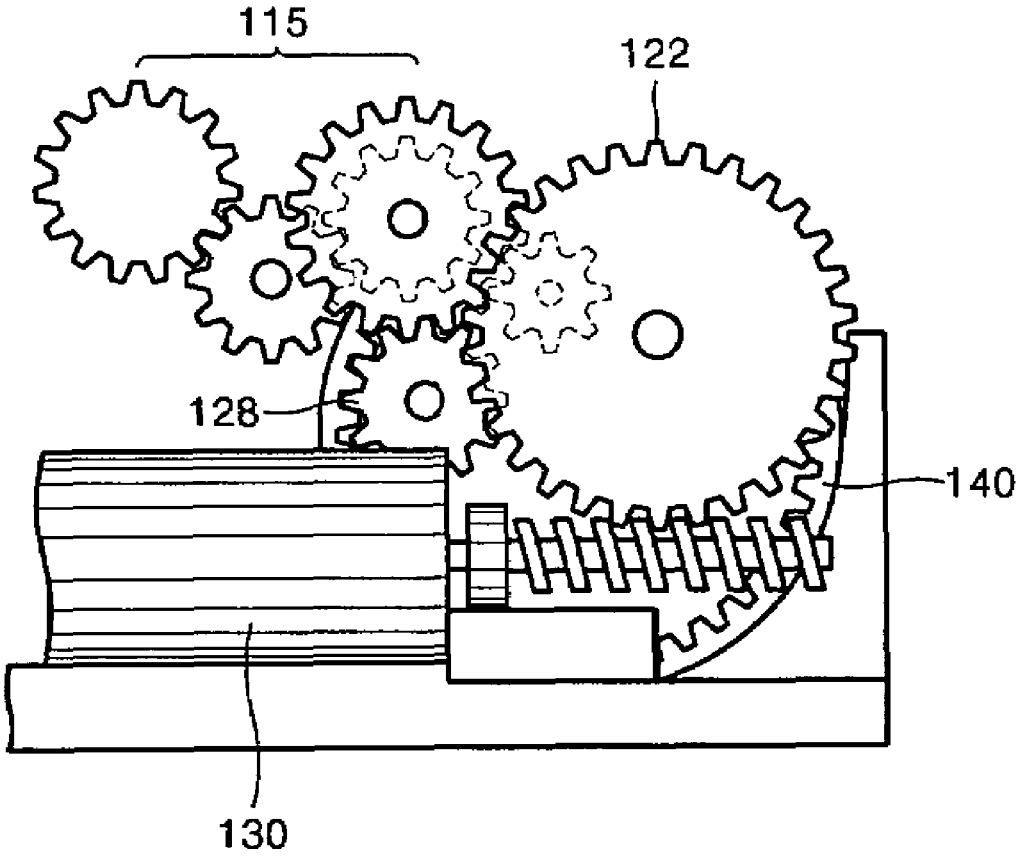
FIG. 6 is a lateral sectional view of a driving force transmission unit of the automatic document feeder shown in FIG. 4.

Referring to FIGS. 4, 5 and 6, an automatic document feeder 100 is shown according to an embodiment of the present invention, and comprises a pickup roller assembly 110, a transmission unit 131, a feeding roller 150, and a discharge roller 170. As shown in FIG. 5, a scan module 200 is provided for scanning sheets of paper P and is installed under the automatic document feeder 100. A glass plate 210, over which paper sheets are transferred during scanning, is provided above the scan module 220. A white bar 220 is placed on the glass plate 210 to make the paper sheets come in close contact with the glass plate 210 during scanning.

The automatic document feeder 100 further comprises a paper supply tray 103 for storing the paper sheets P to be printed, and a discharge tray 104 for storing printed paper sheets P.

The pickup roller assembly 110 comprises a pickup roller 111 for drawing the paper sheets P loaded in the paper supply tray 103, and a separation roller 112 for separately carrying the paper sheets P drawn by the pickup roller 111. A friction pad 113 is installed on the separation roller 112 for separately carrying the paper sheets P via the friction difference between the paper sheets P and the friction pad 113.

The separation roller 112 is fixedly installed on a shaft 114 of the transmission unit 131, and the pickup roller 111 is mounted to rotate simultaneously with the separation roller 112.

Figure 7:
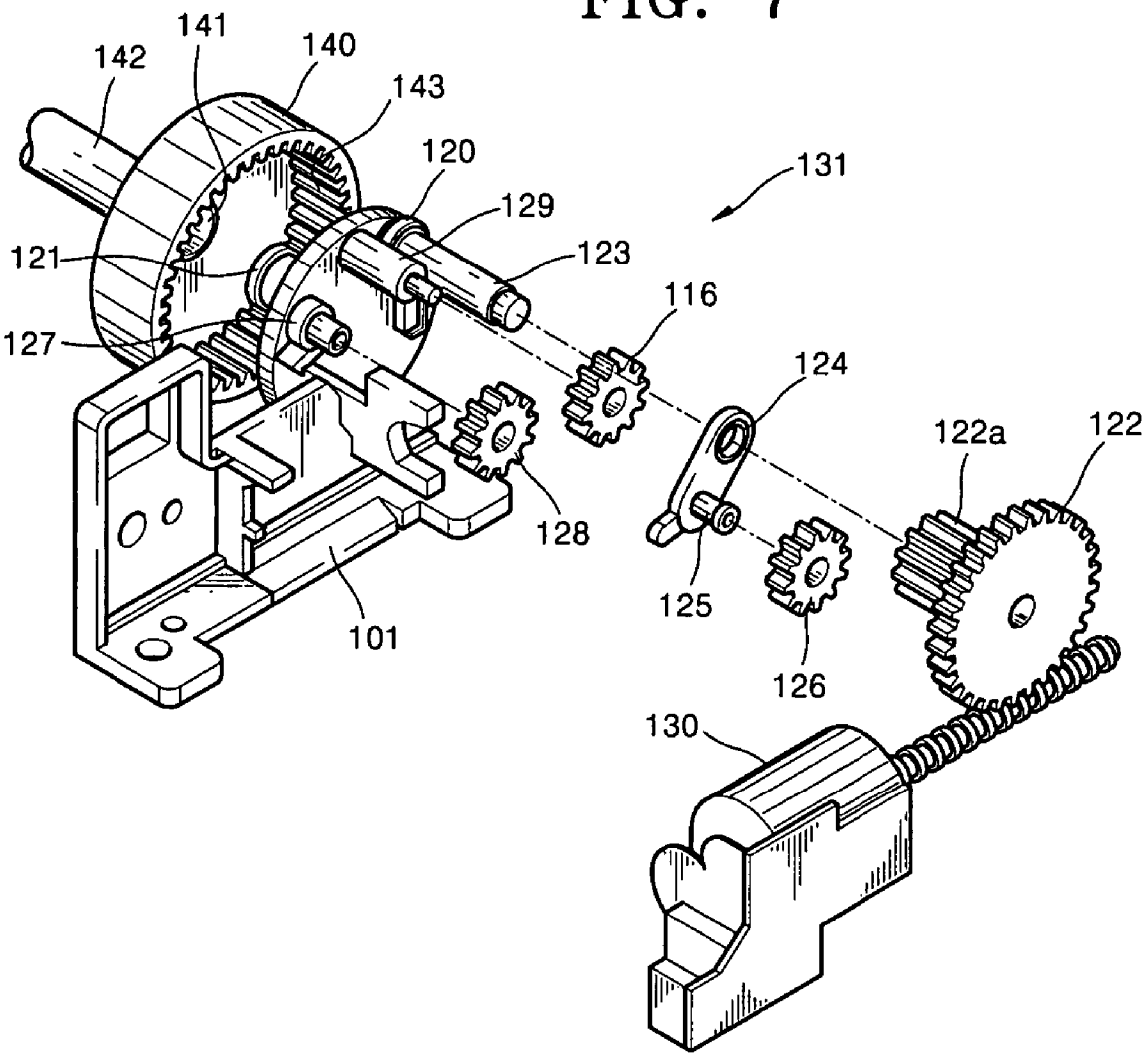
FIG. 7 is an exploded perspective view of a driving force transmission unit of the automatic document feeder shown in FIG. 4.

As shown in FIGS. 6 and 7, the transmission unit 131, which transfers a driving force from a driving motor 130 to the rollers, comprises a bracket 120, a swing arm 124, a swing gear 126, a reverse gear 128, and an internal roller 140.

The internal roller 140 is installed on a feeding roller shaft 142 along with the feeding roller 150. An internal gear 143 is formed on an inner side of the internal roller 140. A recess 141 is also formed on the inner side of internal roller 140 to correspond with the shaft 142.

The bracket 120 is cylinder-shaped to be slidably inserted into the internal roller 140. One side of bracket 120 is fixed to a frame 101, and another side thereof has an axially-protruding pivot member 121 to be rotatably inserted into the recess 141 of internal roller 140. Accordingly, even if the internal roller 140 rotates, the bracket 120 does not rotate.

A reduction gear shaft 123, a reverse gear shaft 127, and a coupling gear shaft 129 are also fixedly attached to the bracket 120.

The swing arm 124 and a reduction gear 122 are provided on the reduction gear shaft 123. The swing arm 124 is rotatably attached to the reduction gear shaft 123. A swing gear shaft 125 is attached to one side of the swing arm 124 to be spaced from the reduction gear shaft 123 by a predetermined distance, and a swing gear 126 is rotatably coupled on the swing gear shaft 125.

The reduction gear 122, which receives a driving force from a driving motor 130 via a worm gear, has a swing coupling gear **122*a* having a smaller diameter than that of the reduction gear 122, to be engaged with the swing gear 126. When the reduction gear 122 is coupled on the reduction gear shaft 123, the swing coupling gear 122*a* is engaged with the swing gear 126 and the coupling gear 116. The reduction gear 122 has a larger diameter than those of the swing coupling gear 122*a* and the swing gear 126**, to thereby increase reduction ratio.

The embodiment example shown in FIG. 7 includes a driving motor 130 which uses a worm gear to transmit the driving force to the driving reduction gear 122, however other kinds of gears can be employed.

When the reduction gear 122 rotates, the swing coupling gear **122*a* and the swing gear 126 are engaged with each other and rotate simultaneously, and the swing arm 124, rotatably attached to the reduction gear shaft 123, pivots on the reduction gear shaft 123 in the same rotation direction as the reduction gear 122. As such, when the swing arm 124 rotates, the swing gear 126, which is engaged with the internal gear 143, makes the internal roller 140** rotate.

The reverse gear 128, rotatably coupled on the reverse gear shaft 127, is engaged with the internal gear 143 and is also engaged with the swing gear 126 selectively when the swing arm 124 rotates.

That is, when the reduction gear 122 in FIG. 7 rotates clockwise, the swing arm 124 also rotates clockwise so that the swing gear 126 is engaged with the reverse gear 128. However, when the reduction gear 122 rotates counterclockwise, the swing arm 124 also rotates counterclockwise so that the swing gear 126 is not engaged with the reverse gear 128.

The reverse gear 128 is designed to make the internal roller 140 rotate clockwise only, regardless of the rotation direction of the driving motor 130.

That is, when the driving motor 130 in FIG. 7 rotates clockwise, the reduction gear 122 rotates counterclockwise so that the swing arm 124 rotates counterclockwise. In this situation, the swing gear 126 is engaged with the internal gear 143 so that the internal roller 140 rotates clockwise.

However, when the driving motor 130 in FIG. 7 rotates counterclockwise, the reduction gear 122 rotates clockwise so that the swing arm 124 rotates clockwise. As such, the swing gear 126 is engaged with the reverse gear 128, and thereby the internal roller 140 rotates clockwise.

As described above, the internal roller 140 always rotates in the same direction with the reverse gear 128. Accordingly, the feeding roller 150 and the discharge roller 170, coupled to the internal roller 140, also rotate in the same direction as that of the internal roller 140. Thus, no clutch is needed to control the rotation direction of the feeding roller 150 and the discharge roller 170, since they always rotate in the same direction.

The coupling gear 116, which is rotatably attached on the coupling gear shaft 129, is engaged with the swing coupling gear 122*a*. As shown in FIG. 6, the coupling gear 116 is also connected to a coupling gear group 115, delivering the driving force to the separation roller shaft 114 upon which the separation roller 112 is fixedly installed.

Returning to FIG. 5, the feeding roller 150 on the feeding roller shaft 142 carries the paper sheets P from the separation roller 112 to the scan module 200. A pinch roller 151 is provided above the feeding roller 150 to compress the paper sheets P toward the feeding roller 150. Since the feeding roller 150 and the internal roller 140 are both placed on the feeding roller shaft 142, they each rotate in the same direction.

Referring to FIG. 4, the discharge roller 170, which is coupled to a transfer gear 160 via a transfer gear group 161 and wherein the transfer gear 160 is attached on the feeding roller shaft 142, discharges paper sheets P scanned by the scan module 200. The transfer gear 160 rotates in the same direction as the internal roller 140.

A compression roller 171 is placed under the discharge roller 170 to push the paper sheets P toward the discharge roller 170.

The operation of the automatic document feeder according to the above exemplary embodiment of the present invention will now be described in greater detail. For the convenience of the description, the driving motor 130 is illustrated using a spur gear instead of a worm gear in FIGS. 9 and 11.

Figure 8:
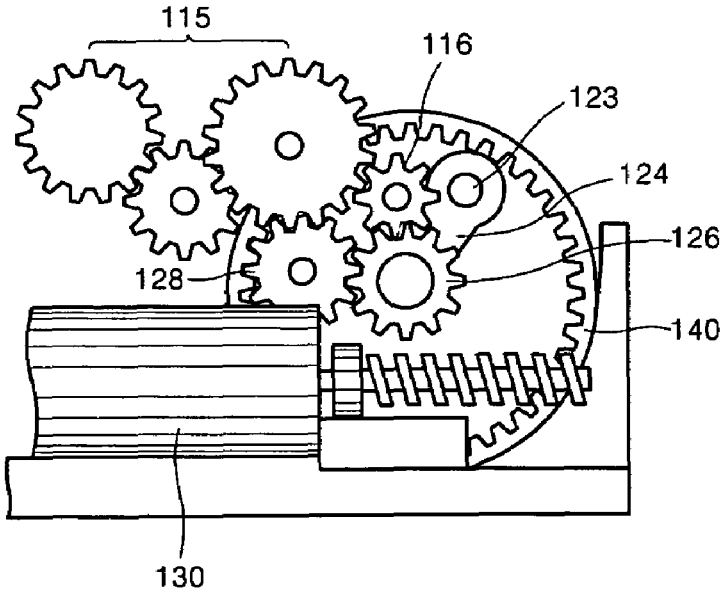
FIG. 8 is a lateral sectional view for explaining an operation of the driving force transmission unit of FIG. 7 when a pickup roller draws a sheet of paper.
Figure 9:
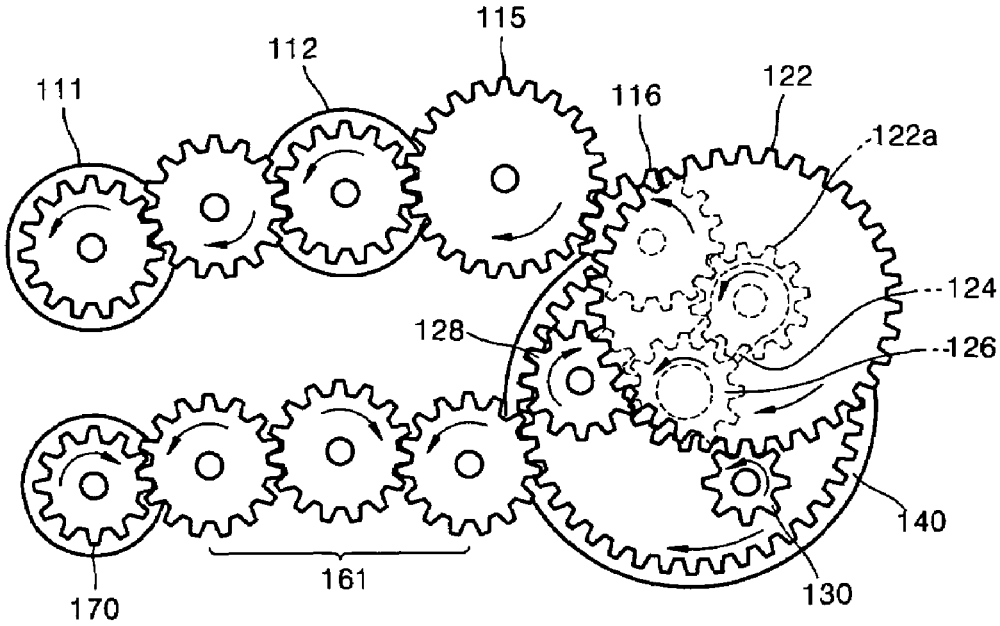
FIG. 9 is a lateral sectional view showing rotation directions of rollers when the pickup roller holds the sheet of paper.

Referring to FIGS. 8 and 9, when the driving motor 130 rotates counterclockwise, the reduction gear 122 and the swing coupling gear 122*a* connected thereto rotate clockwise. As such, the swing arm 124 rotates clockwise due to the rotation of swing coupling gear 122*a* engaged with the swing gear 126.

In this state, the swing gear 126, engaged with the reverse gear 128, rotates counterclockwise and the internal roller 140 rotates clockwise.

The coupling gear 116 is engaged with the swing coupling gear 122*a* to thereby rotate the separation roller 112 via the coupling gear group 115 on the separation roller shaft 114. Accordingly, the separation roller 112 rotates counterclockwise, thereby making the pickup roller 111 rotate in the same direction.

The pickup roller 111 picks up the paper sheets P from the paper supply tray 103, and the separation roller 112 transfer the paper sheets P one by one via a friction difference between the paper sheets P and the friction pad 113.

Since the feeding roller 150 is mounted on the feeding roller shaft 142, the feeding roller 150 rotates in the same direction as the internal roller 140. Also, since the discharge roller 170 is coupled with the transfer gear 160 on the feeding roller shaft 142 via the transfer gear group 161 which is attached to a rib 102 fixed to frame 101, the discharge roller 170 rotates in the same direction as the feeding roller 150.

Therefore, motion from the driving motor 130 is transmitted to the feeding roller 150 and the discharge roller 170 via internal roller 140, and to the pickup roller 111 and the separation roller 112 via the coupling gear 116.

Figure 10:
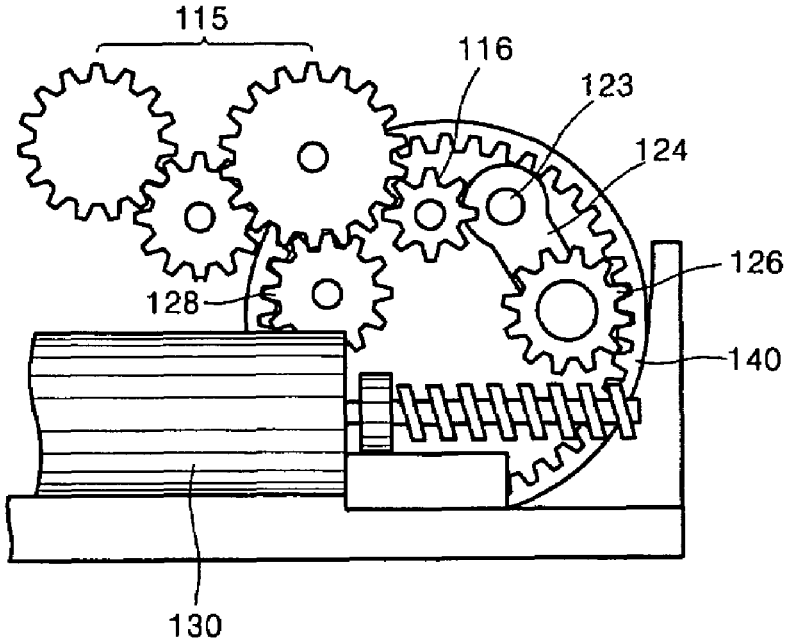
FIG. 10 is a lateral sectional view for explaining an operation of the transmission unit when a feeding roller carries a sheet of paper.
Figure 11:
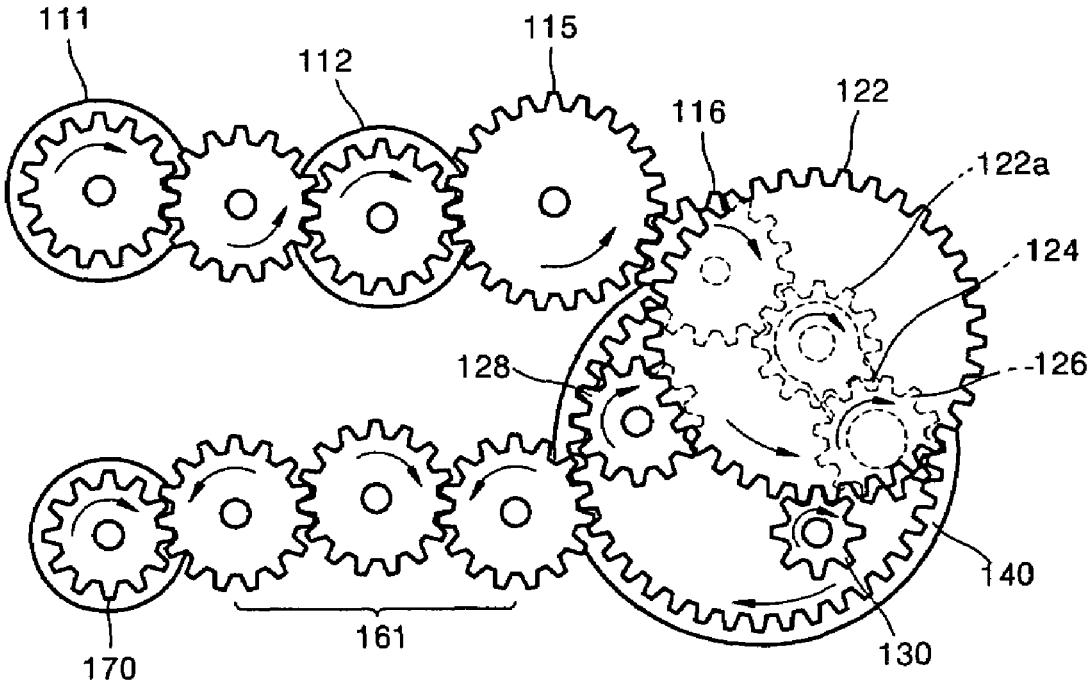
FIG. 11 is a lateral sectional view showing rotation directions of the rollers when the feeding roller carries the sheet of paper.

Referring to FIGS. 5, 10 and 11, when the paper sheet P passes between the feeding roller 150 and the pinch roller 151, a detector (not shown) senses the paper sheet P and instructs the driving motor 130 to rotate clockwise.

The reduction gear 122 and the swing coupling gear 122*a* connected to the driving motor 130 rotate counterclockwise. The swing arm 124 then rotates counterclockwise due to the rotation of the swing coupling gear 122*a* engaged with the swing gear 126.

In this condition, the swing gear 126 rotates with the internal gear 143, thereby making the internal roller 140 rotate clockwise.

Also, the swing gear 126 rotates with the swing coupling gear 122*a* so that the swing arm 124 rotates counterclockwise due to the rotation of the swing coupling gear 122*a*.

The feeding roller 150 rotates in the same direction as the internal roller 140, that is, clockwise, because the feeding roller 150 is connected to the internal roller 140 on the feeding roller shaft 142. The discharge roller 170 rotates in the same direction as the feeding roller 150, that is, clockwise, since it is coupled to the transfer gear 160 which is attached on the feeding roller shaft 142 via the transfer gear group 161 which is attached to the rib 102 fixed to the frame 101. For this reason, the feeding roller 150 and the discharge roller 170 rotate in the same direction when the swing gear 126 rotates with the reverse gear 128.

The separation roller shaft 114 rotates clockwise due to the coupling gear group 115 because the coupling gear 116 is engaged with the swing coupling gear 122*a*. However, the pickup roller 111 and the separation roller 112 do not rotate clockwise due to an additional clutch (not shown). As such, the pickup roller 111 and the separation roller 112 do not pick up and separate the paper sheets P, respectively, while the paper sheet P is carried by the feeding roller 150 and discharged by the discharge roller 170, thereby facilitating supply of the paper sheets P.

As described above, the automatic document feeder of the present invention provides a number of advantages. For example, the document feeder has a smaller structure since it uses the internal roller to reduce the volume of the transmission unit. Also, since the reverse gear is used in the internal roller to make the feeding roller and the discharge roller rotate in the same direction, an additional clutch is not necessary, thus preventing paper jams and reducing manufacturing costs as well.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An automatic document feeder for an image forming apparatus, the automatic document feeder comprising:

a separation roller to separately carry a plurality of paper sheets picked up by a pickup roller;

a feeding roller to carry the paper sheet;

a discharge roller to discharge the scanned paper sheets; and a transmission unit to transmit a driving force from a driving motor, the transmission unit comprising:

an internal roller installed on the same axis with the feeding roller, the internal roller having an internal gear and a rotation hole;

a swing arm rotatably attached to a bracket, the bracket being inserted into the internal roller; and a swing gear rotatably installed on one side of the swing arm, the swing gear being engaged with the internal gear for rotating the internal roller.

2. The automatic document feeder as claimed in claim 1, wherein one side of the bracket is fixed to a frame.

3. The automatic document feeder as claimed in claim 1, further comprising:

a rotation shaft extending from a side of the bracket, the rotation shaft being inserted into the rotation hole provided by the internal roller so that the internal roller rotates while sliding on the rotation shaft.

4. The automatic document feeder as claimed in claim 3, wherein the rotation shaft extends from a side of the bracket facing the internal roller.

5. The automatic document feeder as claimed in claim 1, further comprising:

a reduction gear provided on the bracket and rotatably installed on an axis with the swing arm, the reduction gear receiving a transmission force from the driving motor.

6. The automatic document feeder as claimed in claim 5, wherein the swing gear is coupled to the reduction gear.

7. The automatic document feeder as claimed in claim 5, wherein the reduction gear comprises:

a swing coupling gear having a diameter substantially smaller than that of the reduction gear, the swing coupling gear being engaged with the swing gear.

8. The automatic document feeder as claimed in claim 1, where the internal roller and the feeding roller rotate at substantially the same speed.

9. The automatic document feeder as claimed in claim 1, further comprising:

a reverse gear rotatably installed on the bracket so as to be engaged with the internal gear, the reverse gear being selectively engaged with the swing gear according to a rotation direction of the driving motor.

10. The automatic document feeder as claimed in claim 1 further comprising:

a coupling gear rotatably installed in the bracket for delivering the transmission force to the separation roller.

11. The automatic document feeder as claimed in claim 10, wherein the coupling gear is engaged with the reduction gear.

12. The automatic document feeder as claimed in claim 1, further comprising:

a transfer gear installed on a feeding roller shaft of the feeding roller for delivering the transmission force to the discharge roller.

13. The automatic document feeder as claimed in claim 12, wherein a rotation direction of the transfer gear is the same as the rotation directions of the internal roller and the discharge roller.

* * * * *